US009581302B2

(12) United States Patent
Danesh

(10) Patent No.: US 9,581,302 B2
(45) Date of Patent: Feb. 28, 2017

(54) RECESSED LIGHTING MODULE WITH INTERCHANGEABLE TRIMS

(76) Inventor: Michael D. Danesh, Beverly Hills, CA (US)

( * ) Notice: Subject to any disclaimer, the term of this patent is extended or adjusted under 35 U.S.C. 154(b) by 436 days.

(21) Appl. No.: 13/484,901

(22) Filed: May 31, 2012

(65) Prior Publication Data

US 2013/0322062 A1 Dec. 5, 2013

(51) Int. Cl.
*F21V 21/00* (2006.01)
*F21S 8/02* (2006.01)
*F21V 21/04* (2006.01)

(52) U.S. Cl.
CPC ..... *F21S 8/02* (2013.01); *F21V 21/04* (2013.01)

(58) Field of Classification Search
CPC ..... F21S 8/02; F21V 21/04; F21V 21/044; F21V 21/045; F21V 21/047; F21V 21/041
USPC ..... 362/364, 365
See application file for complete search history.

(56) References Cited

U.S. PATENT DOCUMENTS 3,422,261 A 1/1969 McGinty
3,650,046 A * 3/1972 Skinner ..... 434/328
4,088,827 A 5/1978 Kohaut
4,399,497 A * 8/1983 Druffel ..... 362/362
4,520,435 A 5/1985 Baldwin
4,601,145 A 7/1986 Wilcox
4,723,747 A 2/1988 Karp et al.
4,754,377 A 6/1988 Wenman
4,930,054 A * 5/1990 Krebs ..... 362/149
5,465,199 A 11/1995 Bray et al.
5,544,870 A 8/1996 Kelley et al.
5,562,343 A * 10/1996 Chan et al. ..... 362/365
5,588,737 A 12/1996 Kusmer
5,662,413 A 9/1997 Akiyama
5,836,678 A * 11/1998 Wright et al. ..... 362/364
6,082,878 A 7/2000 Doubek et al.
6,105,334 A 8/2000 Monson et al.
6,364,511 B1 * 4/2002 Cohen ..... 362/368
6,474,846 B1 * 11/2002 Kelmelis et al. ..... 362/365
(Continued)

FOREIGN PATENT DOCUMENTS

CA 2815067 11/2013
DE 9109828 U1 2/1992
EP 1672155 A1 6/2006

OTHER PUBLICATIONS

HALO, HALO LED H4 H7 Collection, SustainabLEDesign, Cooper Lighting, 52 pages (Mar. 28, 2012) (emphasis on page 18 "H7 Collection LED Modules—Halo LED H7 Module Features").
(Continued)

*Primary Examiner* — Nimeshkumar Patel
*Assistant Examiner* — Christopher Raabe
(74) *Attorney, Agent, or Firm* — Blakely Sokoloff Taylor & Zafman LLP

(57) ABSTRACT

A recessed lighting system is provided. The recessed lighting system a universal light module to emit light through a light transmissive cover, a plurality of trims wherein each trim has the same means for attaching to the light module and the same size opening that aligns with the light transmissive cover of the module, but have different flange widths; and a plurality of different size recessed lighting fixture housings that each include an annular cavity to receive the light module attached to one of the trims. Each of the cavities is differently sized and is coupled to the trims using support brackets on the trims.

22 Claims, 5 Drawing Sheets

(56) References Cited

U.S. PATENT DOCUMENTS

| | | | | |
|---|---|---|---|---|
| 6,491,413 | B1 | 12/2002 | Benesohn | |
| 6,585,389 | B2 | 7/2003 | Bonazzi | |
| 6,758,578 | B1 * | 7/2004 | Chou | 362/647 |
| 7,186,008 | B2 | 3/2007 | Patti | |
| 7,320,536 | B2 | 1/2008 | Petrakis et al. | |
| 7,374,308 | B2 * | 5/2008 | Sevack et al. | 362/147 |
| 7,399,104 | B2 | 7/2008 | Rappaport | |
| 7,625,105 | B1 | 12/2009 | Johnson | |
| 7,654,705 | B2 * | 2/2010 | Czech et al. | 362/364 |
| 7,722,208 | B1 | 5/2010 | Dupre et al. | |
| 7,748,887 | B2 | 7/2010 | Zampini, II et al. | |
| 7,959,332 | B2 | 6/2011 | Tickner et al. | |
| 7,967,480 | B2 | 6/2011 | Pickard et al. | |
| 8,038,113 | B2 | 10/2011 | Fryzek et al. | |
| 8,070,328 | B1 | 12/2011 | Knoble et al. | |
| 8,096,670 | B2 | 1/2012 | Trott et al. | |
| 8,215,805 | B2 | 7/2012 | Cogliano et al. | |
| 8,220,970 | B1 | 7/2012 | Khazi | |
| 8,641,243 | B1 | 2/2014 | Rashidi | |
| 8,950,898 | B2 | 2/2015 | Catalano | |
| 9,062,866 | B1 | 6/2015 | Christ et al. | |
| 2002/0172047 | A1 * | 11/2002 | Ashley | 362/364 |
| 2005/0227536 | A1 * | 10/2005 | Gamache et al. | 439/607 |
| 2008/0112170 | A1 * | 5/2008 | Trott et al. | 362/311 |
| 2008/0112171 | A1 * | 5/2008 | Patti et al. | 362/365 |
| 2008/0165545 | A1 | 7/2008 | O'Brien | |
| 2009/0034261 | A1 * | 2/2009 | Grove | 362/294 |
| 2009/0080189 | A1 | 3/2009 | Wegner | |
| 2011/0063831 | A1 | 3/2011 | Cook | |
| 2011/0069499 | A1 | 3/2011 | Trott et al. | |
| 2011/0116276 | A1 * | 5/2011 | Okamura et al. | 362/404 |
| 2011/0134651 | A1 * | 6/2011 | Berman | 362/365 |
| 2011/0170294 | A1 * | 7/2011 | Mier-Langner et al. | 362/294 |
| 2011/0194299 | A1 | 8/2011 | Crooks et al. | |
| 2011/0216534 | A1 | 9/2011 | Tickner et al. | |
| 2011/0226919 | A1 | 9/2011 | Fryzek et al. | |
| 2011/0267828 | A1 | 11/2011 | Bazydola et al. | |
| 2012/0182744 | A1 | 7/2012 | Santiago et al. | |
| 2013/0010476 | A1 | 1/2013 | Pickard et al. | |
| 2013/0051012 | A1 | 2/2013 | Oehle et al. | |
| 2013/0163254 | A1 * | 6/2013 | Chang | F21V 29/004 362/294 |

OTHER PUBLICATIONS

HALO, H7 LED Downlight Trims 49x Series, 6-Inch LED Trims for Use With ML7x LED Modules, Cooper Lighting, ADV110422, rev Aug. 12, 2011, 15 pages.

HALO, LED Module ML706x, Cooper Lighting, Oct. 20, 2009, 4 pages, General Installation for All Modules/p. 1; Tether Installation/pp. 2-3; Installation into HALO H750x Series LED—only (Non-Screw base) Recessed Fixture (p. 4).

CA Office Action (dated Dec. 23, 2013), Application No. 2,778,581, Date Filed—Jun. 1, 2012, (3 pages).

DMF, Inc., "dmfLighting: LED Recessed Lighting Solutions", Info sheets, (Mar. 19, 2012), 4 pages.

Final Office Action (dated Jan. 29, 2016), U.S. Appl. No. 14/183,424, filed Feb. 18, 2014, First Named Inventor: Michael D. Danesh, 21.

CA Office Action (Dated Feb. 1, 2016), Application No. 2,879,486, Filing Date: Jan. 23, 2015, First Named Inventor: Michael D. Danesh., 5.

Non-Final Office Action (dated Jul. 20, 2015), U.S. Appl. No. 14/184,601, filed Feb. 19, 2014, First Named Inventor: Michael D. Danesh, (19 pages).

Non-Final Office Action (dated Jun. 2, 2015), U.S. Appl. No. 12/183,424, filed Feb. 18, 2014, First Named Inventor: Michael D. Danesh, 20 pages.

"CA Office Action (dated Dec. 23, 2013), Application No. 2,778,581, Date Filed—Jun. 1, 2012", 3 pages.

DMF, Inc., Final Office Action (Dated Apr. 27, 2016), U.S. Appl. No. 14/184,601, filed Feb. 19, 2014, First Named Inventor: Michael D. Danesh, 18.

Dmf Lighting, "DME Series Installation Instructions", (Oct. 18, 2011).

* cited by examiner

RECESSED LIGHTING MODULE WITH INTERCHANGEABLE TRIMS

FIELD

An embodiment relates to a recessed lighting fixture system that has a universal light module allowing different sized trims and different recessed lighting housings to fit with the light module. Other embodiments are also described.

BACKGROUND

Recessed lights are light fixtures that are typically installed or mounted into a hollow opening of a ceiling or a wall. When installed, the light from the recessed fixtures appears to shine from a hole in the ceiling, concentrating the light in a downward direction as a broad floodlight or narrow spotlight. Recessed lighting systems generally consist of a trim, a light module, and a housing.

The housing is a casing that is mounted to support members in the building and lines up with a hole in the ceiling. The light module is inserted into the housing and is sturdily coupled to the housing. Electrical connections are also made between the light module and the rough wiring in the building. Thereafter, the trim is coupled to the combined light module and housing unit to provide a finished look.

Although current recessed lighting systems come in a variety of shapes and sizes, switching between sizes requires the purchase of a new trim, a new light module and a new housing as these systems are specifically designed to interoperate with only similar sized parts. This lack of interchangeability leads to increased costs for consumers who must purchase new components to make a trim size change and for manufacturers who must produce and store every combination of trim, light module, and housing to meet consumer's needs. Thus, there is a need for a recessed light module system that provides interchangeability between different sized components.

SUMMARY OF THE INVENTION

There is a need for a recessed lighting system that allows consumers to purchase a single light module that is compatible with multiple trims and housings.

An embodiment of the invention is a recessed lighting system, in which a single type or size light module (a "universal" light module), can itself be fitted with any one of several different size trims. Each of the trims has a different size flange, but the same aperture size. The combination of any one of the trims and the universal light module are sized to fit within the cavity of any one of multiple different sized housings, using a set of brackets on the trim and a set of brackets in a cavity of the housings. By using a universal light module that can work with and fit within multiple standard size housings, and can be fitted with any one of multiple different size or type trims, the recessed lighting system described herein may advantageously allow manufacturers and distributors to carry and store a limited amount of components.

The above summary does not include an exhaustive list of all aspects of the present invention. It is contemplated that the invention includes all systems and methods that can be practiced from all suitable combinations of the various aspects summarized above, as well as those disclosed in the Detailed Description below and particularly pointed out in the claims filed with the application. Such combinations have particular advantages not specifically recited in the above summary.

BRIEF DESCRIPTION OF THE DRAWINGS

The embodiments of the invention are illustrated by way of example and not by way of limitation in the figures of the accompanying drawings in which like references indicate similar elements. It should be noted that references to "an" or "one" embodiment of the invention in this disclosure are not necessarily to the same embodiment, and they mean at least one.

DETAILED DESCRIPTION

Several embodiments are described with reference to the appended drawings are now explained. While numerous details are set forth, it is understood that some embodiments of the invention may be practiced without these details. In other instances, well-known circuits, structures, and techniques have not been shown in detail so as not to obscure the understanding of this description.

Figure 1:
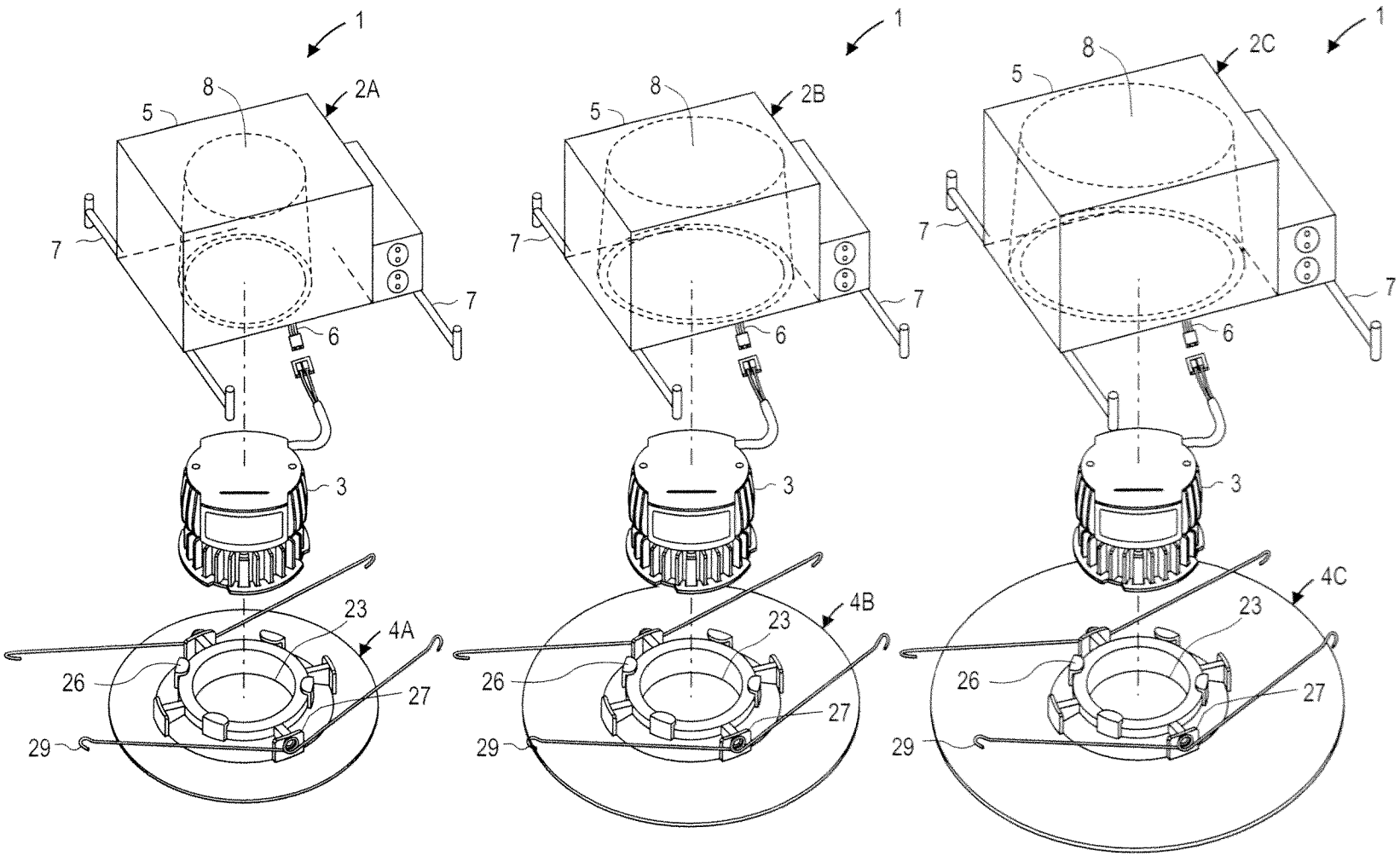
FIG. 1 shows an exploded view of several different recessed lighting systems that have in common a universal light module.

FIG. 1 shows an exploded view of several recessed lighting systems 1. Each recessed lighting system 1 includes a housing 2A, 2B, or 2C, a light module 3 (common to all of the systems), and respective trim 4A, 4B, or 4C. As shown, the multiple housings 2A, 2B, and 2C and the multiple trims 4A, 4B, and 4C are differently sized, but the single light module 3 can fit with any combination of housing 2 and trim 4. Each of the elements of the recessed lighting system 1 will be explained by way of example below.

The housing 2 may have an optional housing box 5, a can (not shown), electrical wires 6 used to bring electrical AC power (e.g., 120 VAC, 240 VAC) to the module 3, and support braces 7, in accordance with well-known or conventional techniques. In one embodiment, the housing 2 acts as a heat barrier to block heat emitted by the light module 3 from reaching possibly flammable items inside a ceiling or crawl space (e.g. insulation) in which the housing 2 has been installed via its support braces 7. The housing 2 may be formed of metals, polymers, metal alloys, and/or heat insulating materials.

Figure 2:
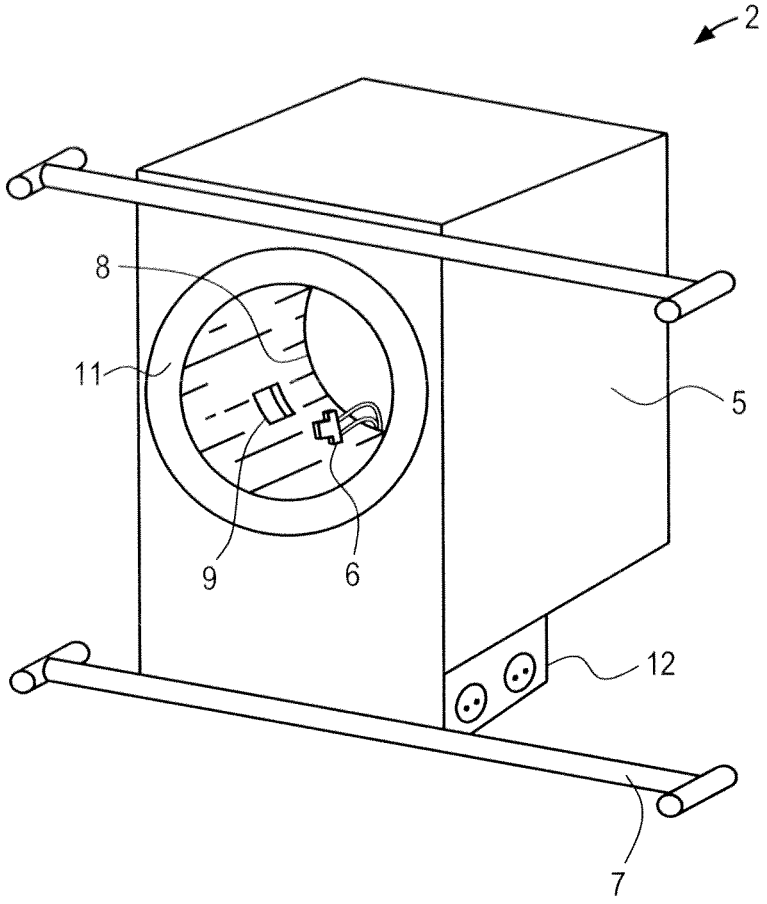
FIG. 2 shows a housing of the recessed lighting system.

As shown in FIG. 2, the housing box 5 for each housing 2 may be a polygon that defines a cavity 8 therein. However, the housing box 5 may be any suitable shape, including an ellipsoid, cone, or cylinder. The cavity 8 is to receive therein the light module 3. The housing box 5 includes retention brackets 9 on the walls of the cavity 8 for receiving complementary support brackets 29 of the trims 4, in order to couple the light module 3 and its trims 4 to the housing 2. The retention brackets 9 may be any device/component for receiving support brackets 29 of the trims 4 (see FIG. 1) to firmly hold the weight of a combined trim 4 and light module 3, up against a housing 2. For example, the retention brackets 9 may be slots formed in a sidewall that defines the cavity 8 as shown in FIG. 2, or they may be the hard, flat sidewall itself against which the support bracket 29 is held by friction.

The cavity 8 that is formed in the housing 2 may be larger in diameter than the light module 3 such that the light module 3 can easily fit into the cavity 8 without coming into direct contact with the walls of the cavity 8. In some embodiments, the diameter of the cavity 8 is substantially larger than the diameter of the light module 3. The size of the cavity 8 may be pursuant to popular industry specifications for recessed lighting cans. For example, the cavity 8 may be about four inches in diameter in compliance with Underwriters Laboratories (UL) 1598 or consistent with a "4-inch recessed lighting can." As shown in FIG. 1, the trims 4 may be designed to couple the light module 3, which may be of a single type or size, to multiple types or sizes of housings 2. For example, as shown in FIG. 1 housings 2A, 2B, and 2C have different size cavities 8, but the single sized light module 3 fits inside all these housings 2A, 2B, and 2C with corresponding different sized trims 4A, 4B, and 4C. In some embodiments, the light module 3 is substantially smaller than the cavity 8 of the smallest housing 2. For example, in one embodiment, the module 3 has a diameter substantially smaller than that of the cavity 8 of any standard 4-inch recessed light can.

The cavity 8 is open on a bottom end to allow light from a light module 3 coupled therein to illuminate an outside environment (e.g. a room). The bottom end of the cavity 8, which is open, may be surrounded by a thin ring 11, e.g., made of rubber or other suitable material, to allow for a better seal with the trims 4 when the light module 3 is secured within the cavity 8. The light module 3 may be a LED module that is a replacement or retrofit for an incandescent bulb socket in the cavity 8, and as such may be the primary or sole light source within the cavity 8.

The electrical wires 6 of the housing 2 provide electricity to the light module 3. The electrical wires 6 may include two or more hot lines that deliver electricity and one or more lines that ground the housing 2 and the light module 3. In one embodiment, a main line from a circuit breaker is run directly to a junction box 12 on the housing 2. The electrical wires 6 connect to the main line via the junction box 12. The junction box 12 may regulate current through an embedded circuit to supply a stable voltage within the operating parameters of the light module 3 or the junction box 12 may be simply an electrical splitter. The electrical wires 6 may include a plug connector that allows for easy connection with a complimentary connector of the light module 3. For example, the plug connector may be a keyed connector or interlocking connector.

The housing 2 may include one or more support braces 7. Although shown running parallel alongside the width of the housing box 5, the support braces 7 may be positioned in any fashion along the housing box 5. The support braces 7 couple the housing box 5 to the structure of a building. For example, the support braces 7 may couple the housing box 5 between studs in the ceiling of a house. In this embodiment, the mounting braces 7 are sixteen inches long, designed to fit within standard wooden framing in ceilings or walls. In some embodiments, the length of the support braces 7 are adjustable to fit within non-standardized structures. The support braces 7 may be coupled to the structure using any known device or method for coupling. For example, the support braces 7 may be secured to the frame of a house with any combination of resins, clips, screws, bolts, or clamps. In one embodiment, the housing box 5 is moveable along the support braces 7 to allow the housing box 5 to slide along the mounting braces 7 to place the light module 3 in the optimum position according to the consumer's preferences.

Figure 3:
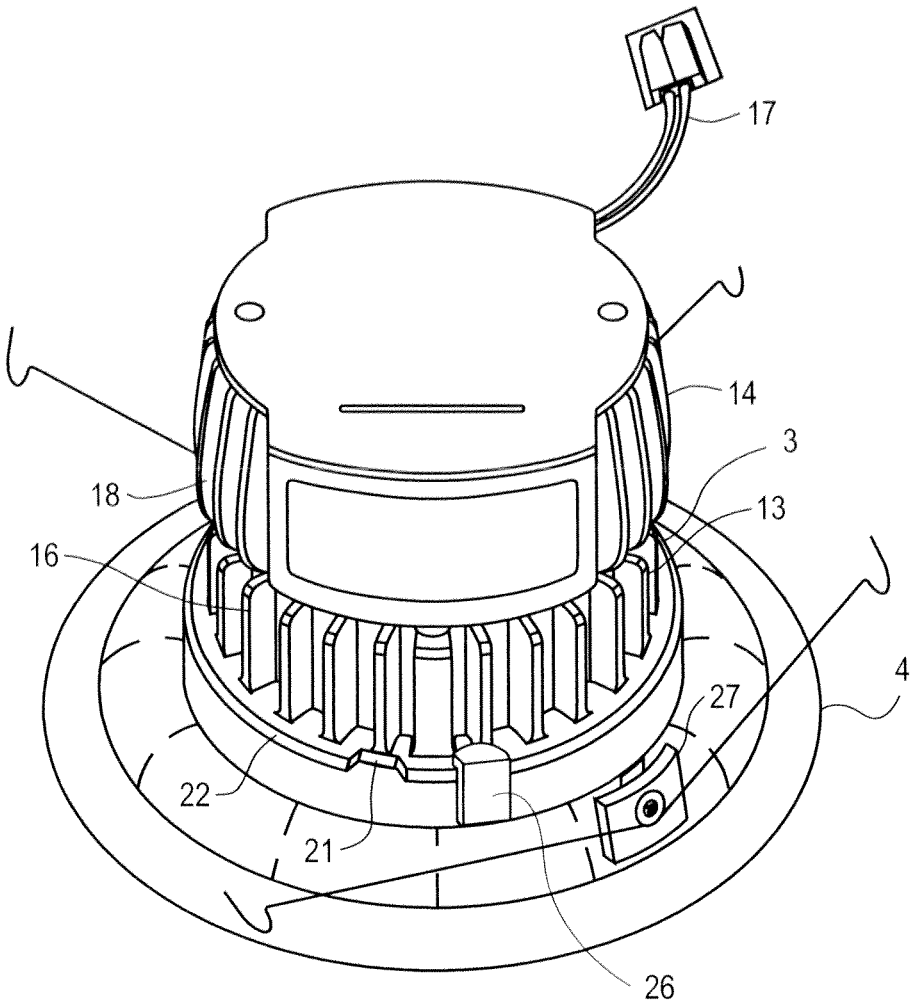
FIG. 3 shows an example light module coupled to a trim of the recessed lighting system.
Figure 4:
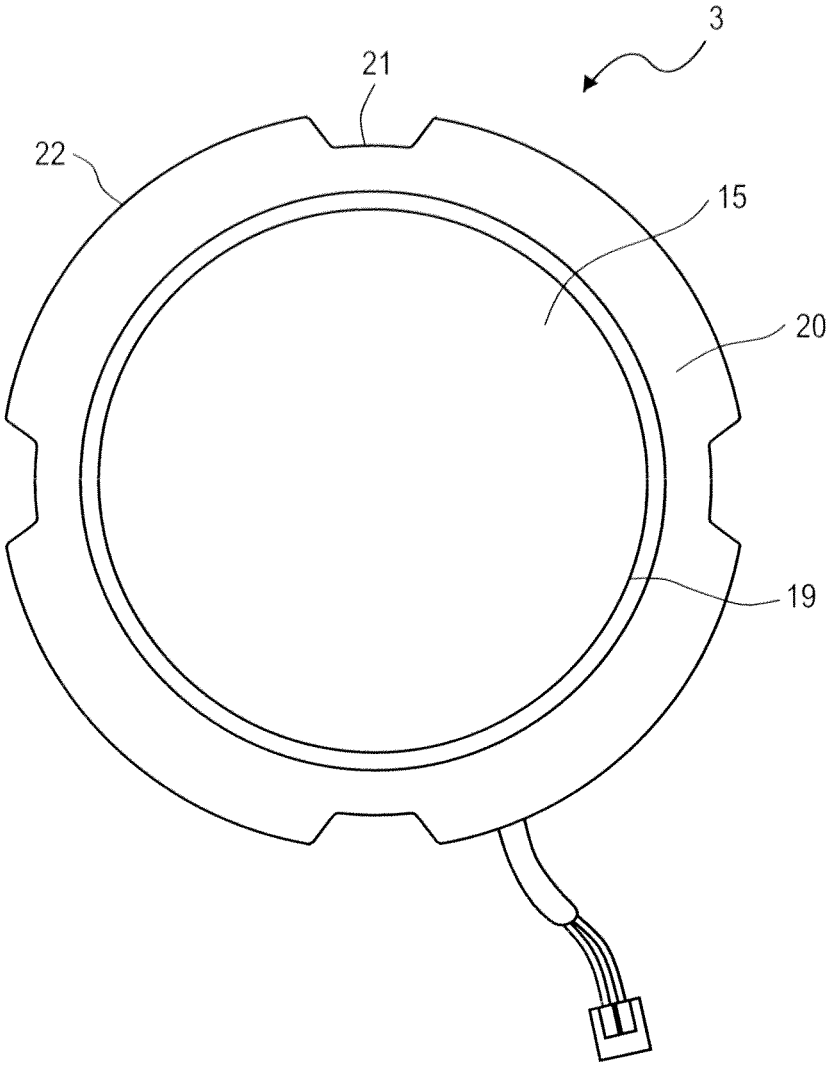
FIG. 4 shows a front view of the light module.

FIG. 3 shows an example of the light module 3 coupled to a trim 4. The light module 3 is comprised of a light source 13 and a power supply 14. The light source 13 may be any device or combination of devices for emitting light. For example, the light source 13 may be a light emitting diode (LED), organic light-emitting diode (OLED), and polymer light-emitting diode (PLED). As shown in the bottom of FIG. 4, the light module 3 may include an integrated lens 15 and a reflector (not shown) for focusing, multiplying, or adjusting light emitted by the light source 13. For example, multipliers may be used which control the omni-directional light from "A" style bulbs. In comparison, other optical elements may be used to provide a diffused light. In one embodiment, the lens 15 also provides a protective barrier for the light source 13 and shields the light source 13 from moisture or inclement weather. In one embodiment, the lens 15 and the light source 13 are contained in a single indivisible unit.

Referring to FIG. 3, in one embodiment, the light source 13 includes one or more heat sinks 16 to cool the light source 13. Although the heat sinks 16 are shown as passive components that cool the light source 13 by dissipating heat into the surrounding air, active heat sinks (e.g. fans) may also be used. In one embodiment, the heat sink 16 is defined by a set of fins surrounding an outside casing of the light source 13. The heat sink 16 may be composed of any thermally conductive material. For example, the heat sink 16 may be made of aluminium alloys, copper, copper-tungsten pseudo-alloy, AlSiC (silicon carbide in aluminium matrix), Dymalloy (diamond in copper-silver alloy matrix), an E-Material (beryllium oxide in beryllium matrix).

The power supply 14 is a device that supplies or regulates electrical energy to the light source 13, and thus powers the light source 13 to emit light. The power supply 14 may by any type of power supply, including power supplies that deliver an alternating current (AC) or a direct current (DC) voltage to the light source 13. The power supply 14 may receive electricity from an external source through electrical wires 17. In one embodiment, the power supply 14 receives electricity from the housing 2 via the electrical wires 6. In this embodiment, the electrical wires 17 of the power supply 14 are connected to the electrical wires 6 of one of the housings 2. In one embodiment, the electrical wires 17 of the power supply 14 include a plug connector that allows for easy connection with a complimentary connector of the housing 2. For example, the plug connector may be a keyed connector or interlocking connector.

Upon receiving electricity, the power supply 14 may regulate current or voltage through an embedded circuit to supply a stable voltage or current within the operating parameters of the light source 13. The power supply 14 may transfer electricity to the light source 13 through complimentary electrical connectors (not shown) on each unit 13 and 14.

In one embodiment, the light source 13 and the power supply 14 are directly coupled together along a set of surfaces. This direct coupling allows for dissipation of heat from the light source 13 through the power supply 14. The light source 13 and the power supply 14 may be coupled together using, for example, any combination of resins, clips, screws, bolts, or clamps. In one embodiment, a thermal paste may be applied between the adjoining surfaces of the light source 13 and the power supply 14 to further assist in the transfer and dissipation of heat. In one embodiment, the power supply 14 may include a heat sink 18 to dissipate the heat generated by the power supply 14, and the absorbed heat generated by the light source 13. In one embodiment, the heat sink 18 is defined by a set of thermally conductive fins surrounding an outside casing of the power supply 14 and similar to those on the light source 13.

In one embodiment, the light source 13 and the power supply 14 are similarly sized such that the units can be easily, compactly, and efficiently coupled together. For example, the light source 13 and the power supply 14 may be generally cylindrically shaped with similar diameters. In this embodiment, heat sink fins on both the light source 13 and the power supply 14 may be aligned such that cooling air can efficiently pass through/over the fins and dissipate heat. In another embodiment, the light source 13 and the power supply 14 are a single indivisible unit.

In one embodiment, referring to FIG. 4, a front end of the light source 13 for emitting light includes a light opening 19 and a locking surface 20 that surrounds the light opening 19. The locking surface 20 may be rounded at the outer and inner peripheries as shown, and may include one or more slots 21 formed along the outer periphery of the surface 20, for receiving and engaging complimentary elements of a trim 4. As seen in FIG. 3, the slots 21 may be beveled to form an isosceles trapezoid or similar shape. The beveled shape of the slots 21 provides an easier connection with the trims 4 that prevents deformation of the slots 21 and complimentary elements of the trims 4 during engagement and disengagement. The slots 21 may be uniformly distributed around the light opening 19. For example, there may be four slots 21 located at 0°, 90°, 180°, and 270° around the light opening 19. However, in other embodiments the slots 21 may be non-uniformly distributed to, for example, account for weight distribution inconsistencies of the light module 3. In other embodiments, the slots 21 may be replaced with other devices for coupling the light module 3 to the trims 4. For example, the light module 3 may include a threaded structure for engaging a complimentary threaded structure of the trims 4 or a set of clamps for coupling with the trims 4.

In one embodiment, a respective trim 4 is associated with each of the different housings 2; a single type and size light module 3, which is is substantially smaller than the cavity 8 of the smallest housing 2, can be fitted to any one of the different trims 4, within the associated housing 2. This compatibility between multiple housings 2 and a single light module 3 allows a retailer to carry a single light module 3 that can be used with multiple housings 2 (and their associated trims 4).

The trim 4 serves a primary purpose of covering the hole in the ceiling or wall in which the housing 2 and the light module 3 reside. The trim 4 accomplishes this by attaching to the border surface 20 of the light module 3, allowing light to pass through an annular aperture 23 of the of the trim 4, and then laying flush with and covering from view the edge of the hole in the surrounding ceiling or wall section. In doing so, the trim 4 helps the recessed lighting system 1 appear seamlessly integrated into the ceiling or wall. The size and design of the trim 4 may depend on the size of the hole in which the housing 2 has been fitted and that it must conceal as well as the aesthetic decisions of the consumer.

The trim 4 may form an uninterrupted thermal path with the light module 3. The trim 4 may be formed of any thermally conductive material that assists in dissipating heat from the light module 3. For example, the trims 4 may be made of aluminum alloys, copper, copper-tungsten pseudo-alloy, AlSiC (silicon carbide in aluminum matrix), Dymalloy (diamond in copper-silver alloy matrix), and E-Material (beryllium oxide in beryllium matrix). By assisting in the dissipation of heat from the light module 3, the trims 4 allow for the use of light modules 3 with increased power. For example, the uninterrupted thermal path between the trims 4 and the light module 3 allows dissipation of heat from a 20 W light source 13 for more than eight hours without degradation of the light source 13 or the power supply 14.

Figure 5:
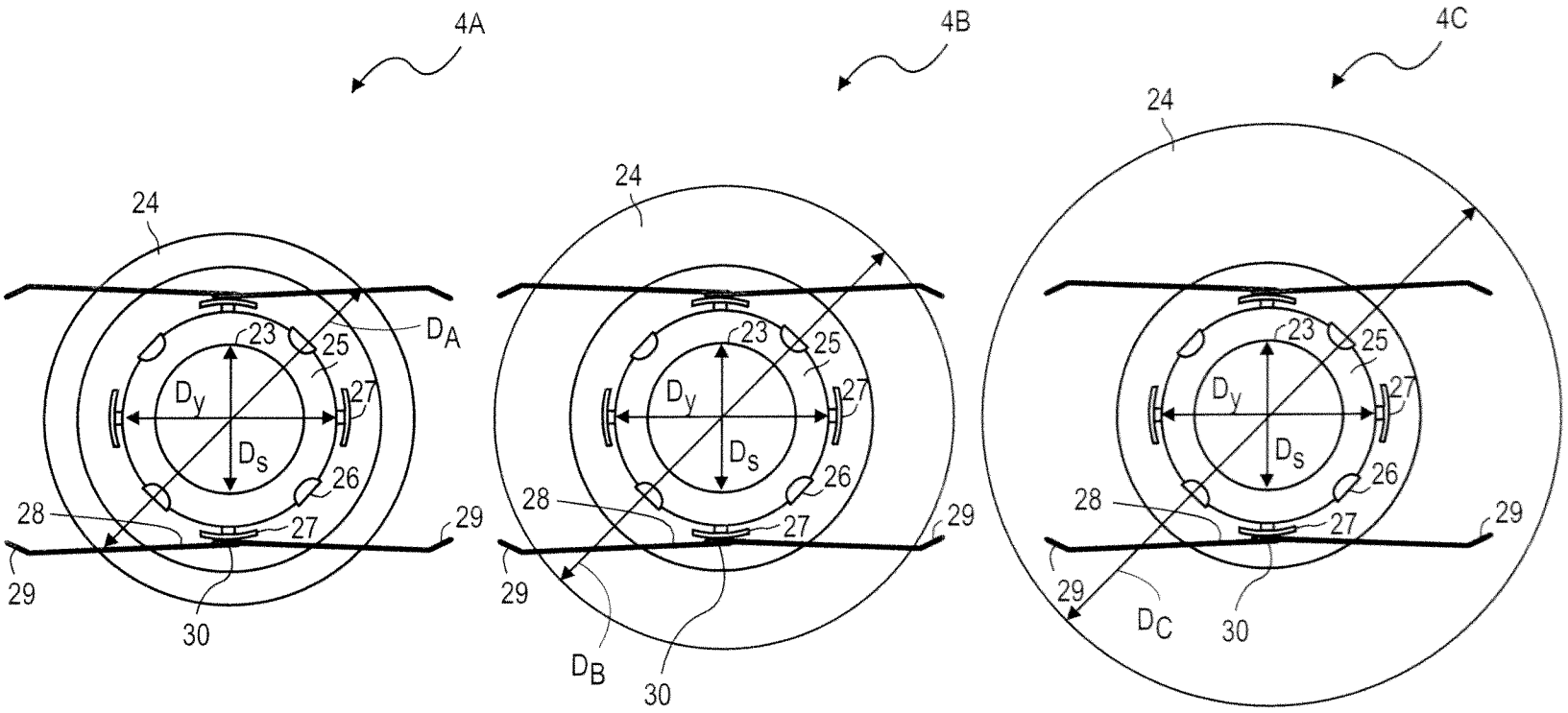
FIG. 5 shows a back face of three different size trims.

FIG. 5 shows a back side of several examples of different sized trims 4A, 4B, and 4C. The trims 4A, 4B, and 4C include an outer flange 24 whose open center section defines the aperture 23. In one embodiment, the outer flange 24 is separately manufactured from a center piece that contains the aperture 23, and is bonded or otherwise joined to the center piece. The outer flange 24 is used to cover/hide from view the outside housing 2, the light module 3, and the edge of the corresponding hole in the wall or ceiling, while the aperture 23 exposes light emitted from the light source 13 to a room. The aperture 23 of each of the differently sized trims 4 may be essentially identical, e.g., have the same diameter $D_S$; however, the diameter of the flange 24 is different for each of these differently sized trims 4. For example, in a set of three trims 4A, 4B, and 4C shown in FIG. 5, the diameter $D_S$ of each aperture 23 may be about two inches, while the outside diameters $D_A$, $D_B$, and $D_C$ of the flanges 24 are about 4 inches, 6 inches, and 7 inches, respectively.

The trim 4 may include a flat border surface 25 that surrounds the aperture 23 and is surrounded by several tabs 26 and coupled to the flange 24. The border surface 25 of the trim 4 may have an outer diameter that is about equal to or slightly smaller than the diameter of the locking surface 20 of the light module 3 (see FIG. 4) and that has an equal diameter $D_Y$ for each of the trims 4. In one embodiment, the spacing between the tabs 26 on each of the trims 4 is about identical to the spacing between the slots 21 on the light module 3. For example, if slots 21 are located at 0°, 90°, 180°, and 270° around the light opening 19 of the light module 3, the tabs 26 are located at 0°, 90°, 180°, and 270° around the aperture 23. FIG. 3 shows the light module 3 coupled to one of the trims 4 using a tab 26 of the trim 4 and an associated one of the slots 21 of the light module 3. The tab 26 is sized to fit within or pass through the associated slot 21 when the trim 4 and the module 3 are aligned, such that the light module 3 and the trim 4 can be twistably coupled together. As shown in FIG. 3, the tab 26 has passed through the slot 21 and has been moved to contact the top surface of a ridge 22 of the light module 3 thereby creating a coupling connection. In one embodiment, the tabs 26 may be beveled to form an isosceles trapezoid or similar type of shape. The beveled shape of the tabs 26 provides an easier connection with the light module 3 that prevents deformation of the tabs 26 and the complimentary section of the ridges 22 of the light module 3. In one embodiment, the tabs 26 on each of the trims 4A, 4B, and 4C are identically shaped and sized. As described, the light module 3 and the trims 4 are directly coupled together through a simple twisting motion of the light module 3 relative to the trim 4 without the assistance of tools.

As noted above, the trim 4 comes into direct contact with the light module 3 after being coupled together. For example, the border surface 25 of a trim 4 may be in direct contact with the locking surface 20 of the light module 3, such that the trim 4 and the light module 3 are coupled together. By being formed of thermally conductive materials and being directly connected, the trim 4 may create an uninterrupted thermal path from the light module 3 to the outside atmosphere. Accordingly, the light module 3 may be made smaller as heat dissipation is not only performed by the light module 3 itself, but also by an attached trim 4. Traditionally, small LED light modules (e.g., 4-6 inches in diameter) were not used by manufacturers because of their poor heat dissipation and overheating issues caused by reduced surface area. For example, overheating may cause color shift and exponential decrease of lime-time if the Tc points of LEDs exceed the manufacturer's specification. By allowing the trim 4 to act as an additional heat sink, the light module 3 may be smaller in size. For example, the uninterrupted thermal path between the trims 4 and the light module 3 may allow dissipation of heat from a 20 W light source 13 for more than eight hours without degradation to the light source 13 or the power supply 14. In one embodiment, a thermal paste may be applied between the abutting surfaces of the light module 3 and the trim 4 to further assist in the transfer and dissipation of heat.

In one embodiment, the trim 4 further includes one or more mounting blocks 27. The mounting blocks 27 are protrusions, on the flange 24, that support mounting arms 28. The mounting blocks 27 may be symmetrical e.g., in pairs, across the aperture 23 such that they can uniformly support the trim 4 as the latter is coupled to the housing 2. In one embodiment, the mounting blocks 27 are located between the border surface 25 and an outer perimeter of the flange 24 such that the mounting blocks 27 can be inserted into the cavity 8 while the flange 24 covers the hole in the ceiling or wall containing the lighting system 1.

As seen in the example shown in FIG. 5, each mounting arm 28 includes two support brackets 29 that extend from a pivoting joint 30. In one embodiment, the pivoting joint 30 is fixed at one of the mounting blocks 27 using any known method and device for coupling. For example, the pivoting joint 30 may be coupled to the mounting block 27 using any combination of resins, clips, screws, bolts, or clamps. The support brackets 29 may be v-springs, tension springs, or friction clips. The support brackets 29 are individually bendable about the pivoting joint 30 allowing the support brackets 29 to be bent and inserted into the cavity 8 of the housing 2. Upon being inserted into the cavity 8 and released, the support brackets 29 engage the complementary retention brackets 9 that are attached to the walls of the cavity 8 (see FIG. 2). The retention brackets 9 may be any device/component for receiving the support brackets 29 and firmly coupling the combined trim 4 and light module 3 to the housing 2. For example, the retention brackets 9 may be slots formed in a sidewall that defines the cavity 8 as shown in FIG. 2 or the hard, flat sidewall itself.

Traditionally, support brackets 29 or similar devices are located on the light module 3 instead of the trim 4. However, housings 2 often use different retention brackets 9 that are not compatible with support brackets 29 on a particular light module 3. By locating the support brackets 29 on the trim 4 as described herein instead of the light module 3, only the relatively inexpensive trim 4 needs to be changed or replaced to be compatible with the retention brackets 9 of various housings 2. Thus, a single light module 3 may be used with a variety of different housings 2.

While certain embodiments have been described and shown in the accompanying drawings, it is to be understood that such embodiments are merely illustrative of and not restrictive on the broad invention, and that the invention is not limited to the specific constructions and arrangements shown and described, since various other modifications may occur to those of ordinary skill in the art. The description is thus to be regarded as illustrative instead of limiting.

What is claimed is:

1. A trim for a recessed lighting fixture, comprising:

an annular region having an upward facing annular border surface for receiving a universal light module, wherein the annular region is surrounded by a flange, the annular region forming an aperture for light to pass through and downward from the universal light module, and the flange to cover a hole in a structure in which the recessed lighting fixture is installed;

a mounting arm coupled to the annular region and adapted to be coupled to a recessed light housing of the recessed lighting fixture; and a means for attaching the trim to the universal light module, wherein the combined (a) means for attaching the trim and (b) the universal light module can be fitted into a plurality of different size recessed lighting housings, wherein the means for attaching the trim to the universal light module is a twist and lock mechanism formed on the annular region and for which the trim has to be twisted relative to the light module so that the trim and the light module can become attached to each other.

2. The trim of claim 1, wherein the means for attaching is a plurality of "L" shaped tabs formed on an outer edge of the annular region, wherein the "L" shaped tabs extend upward from the upward facing annular border surface and extend inward toward the aperture.

3. The trim of claim 1, wherein the means for attaching allows the trim to be attached to the light module in a tool free manner.

4. The trim of claim 1, wherein the trim is a heat sink for the light module.

5. The trim of claim 1, wherein the annular region includes a mounting block to which the mounting arm is coupled.

6. The trim of claim 1, wherein the mounting arm is one of a V-spring and a friction clip.

7. A recessed lighting system, comprising:

a single light module comprising an opening for emitting light through and having a light source and a power supply for the light source contained therein; and a plurality of different size trims that each comprise:

an annular region having an upward facing annular border surface that surrounds an opening for light to pass through and aligns with the opening of the single light module and receives the single light module; and a flange region that has a different diameter and covers a hole in a structure in which the recessed lighting system is installed;

wherein each trim has a same means for attaching to the single light module, wherein the same attaching means is a twist and lock mechanism formed on the annular region and for which the trim has to be twisted relative to the light module so that the trim and the light module can become attached to each other, wherein each trim further comprises mounting arms for coupling to a housing that receives the single light module.

8. The recessed lighting system of claim 7, further comprising:

a plurality of housings each having a different size cavity in which to receive the light module, wherein the perimeter of the cavity is larger than the perimeter of the light module.

9. The recessed lighting system of claim 7, wherein the light module further comprises:

a locking surface surrounding the opening of the light module; and a plurality of notches formed along the perimeter of the locking surface and separated by one or more ridges formed on the perimeter of the locking surface.

10. The recessed lighting system of claim 9, wherein the means for attaching each of the trims to the single light module comprises:

a plurality of tabs to fit through the plurality of notches of the light module and for coupling each of the trims to the single light module by engaging the ridges of the light module through a twist and lock motion.

11. The recessed lighting system of claim 7, wherein the single light module comprises an outer casing in which the light source, the power supply, and a light transmissive cover that covers the opening through which light from the light source is to be emitted are contained as a single indivisible unit, and wherein the light source is a light emitting diode (LED) light source.

12. The recessed lighting system of claim 7, wherein the trims act as a heat sink for the single light module.

13. A light module, comprising:

a light source that emits light, wherein the light source does not include mounting arms for coupling the light module to a recessed light housing;

an attachment device configured to couple the light source to any one of a plurality of trims each of which has a same size annular region having an upward facing annular border surface that receives the light source and surrounds an opening for light to pass through, but a different size flange region that (a) surrounds the annular region and (b) covers a hole in which the light module is installed;

a lens integrated into the light source for amplifying and directing emitted light;

a power supply that regulates current received from an external source to power the light source, wherein the attachment device includes:

a locking surface surrounding an opening of the light source; and a plurality of notches that are separated by one or more ridges which are coupled to a perimeter of the locking surface;

wherein the plurality of notches are sized to allow a plurality of tabs on the annular region of each trim to fit through the plurality of notches and engage the ridges through a twist and lock motion.

14. The light module of claim 13, wherein the light source comprises:

a plurality of fins around a perimeter of the light source for dissipating heat produced by the light source.

15. The light module of claim 13, wherein the power supply comprises:

a plurality of fins around a perimeter of the power supply for dissipating heat produced by the light source.

16. The light module of claim 13, wherein the light source is a light emitting diode (LED).

17. A trim for multiple recessed light housings, comprising:

an annular region forming an aperture having an upward facing annular border surface adapted to be coupled to a light module;

a flange surrounding the annular region, the flange to cover a hole in a structure in which the light housings are installed;

a mounting block formed on the annular region;

a mounting arm coupled to the mounting block and adapted to be coupled to each of the multiple recessed light housings; and a twist and lock mechanism formed on the annular region and for which the trim has to be twisted relative to the light module so that the trim and the light module can become attached to each other.

18. The trim of claim 17, wherein the twist and lock mechanism comprises a plurality of tabs coupled to the annular region and surrounding the annular region, wherein the tabs extend upward from the border surface and extend inward toward the aperture and are adapted to friction fit to the light module.

19. The trim of claim 17, wherein the mounting arm is one of a V-spring and a friction clip.

20. The recessed lighting system of claim 7, wherein the twist and lock attaching means is a plurality of "L" shaped tabs formed on an outer edge of the annular region of the trim, wherein the "L" shaped tabs extend upward from the annular region of the trim and extend inward toward the opening of the trim.

21. The light module of claim 13, wherein the annular region of each trim has a plurality of "L" shaped tabs formed on an outer edge of the annular region of the trim, wherein the "L" shaped tabs extend upward from the annular region of the trim and extend inward toward the opening of the trim.

22. The trim of claim 17, wherein the annular region of the trim has a plurality of "L" shaped tabs formed on an outer edge of the annular region of the trim, wherein the "L" shaped tabs extend upward from the annular region of the trim and extend inward toward the aperture.

* * * * *